United States Patent [19]

Breyley

[11] 4,046,374

[45] Sept. 6, 1977

[54] WALKING AID

[76] Inventor: Thomas E. Breyley, 3717 Hopper Hill Road, Cincinnati, Ohio 45230

[21] Appl. No.: 360,084

[22] Filed: May 14, 1973

[51] Int. Cl.[2] ..... A63B 23/04

[52] U.S. Cl. ..... 272/70.3; 280/42; 297/6

[58] Field of Search ..... 272/70, 70.3, 58; 297/6; 280/42

[56] References Cited

U.S. PATENT DOCUMENTS

| | | | |
|---|---|---|---|
| 2,459,066 | 1/1949 | Duke | 297/6 |
| 2,734,554 | 2/1956 | Ries | 272/70.3 |
| 3,130,814 | 4/1964 | Del Aquila | 182/15 |
| 3,331,614 | 7/1967 | McClintock | 280/42 |
| 3,707,285 | 12/1972 | Martin | 272/62 |

FOREIGN PATENT DOCUMENTS

| | | | |
|---|---|---|---|
| 832,913 | 4/1960 | United Kingdom | 272/70.3 |

*Primary Examiner*—Richard C. Pinkham
*Assistant Examiner*—William R. Browne
*Attorney, Agent, or Firm*—James W. Pearce; Roy F. Schaeperklaus

[57] ABSTRACT

A walker which comprises a pair of interconnecting side frames. Each of the side frames includes a pair of upright legs and a hand grip bar connecting upper end portions of the legs. A caster is adapted to support each leg. A spring is mounted in association with each caster to urge the leg associated therewith to a raised position in which the lower end of the associated leg is spaced above a surface on which the casters run. The springs yield when weight is applied to the bars to cause the lower ends of the legs to engage the supporting surface to lock the walker in position.

5 Claims, 11 Drawing Figures

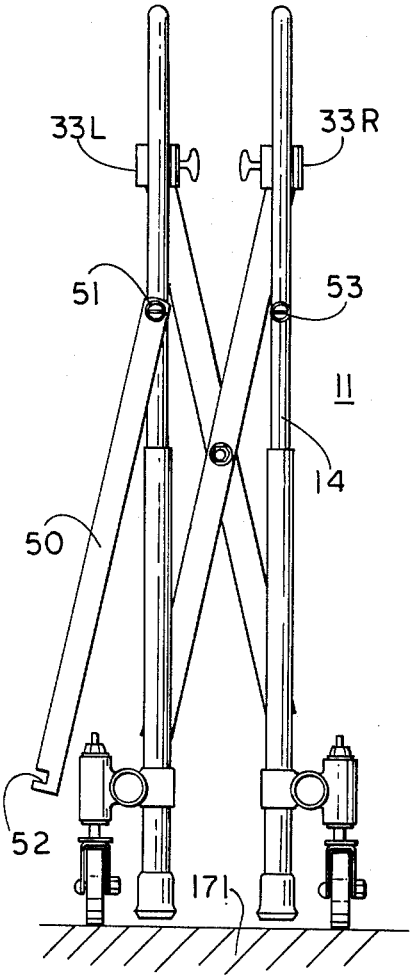
FIG. 7
FIG. 6
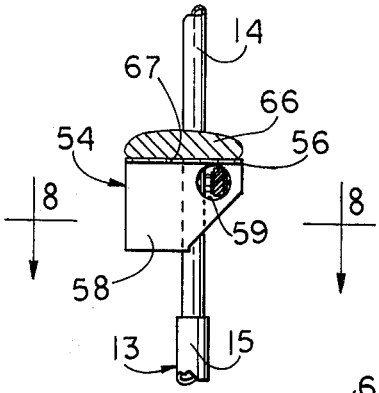
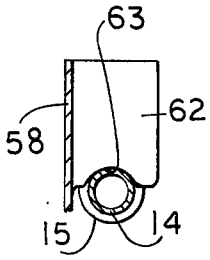
FIG. 8
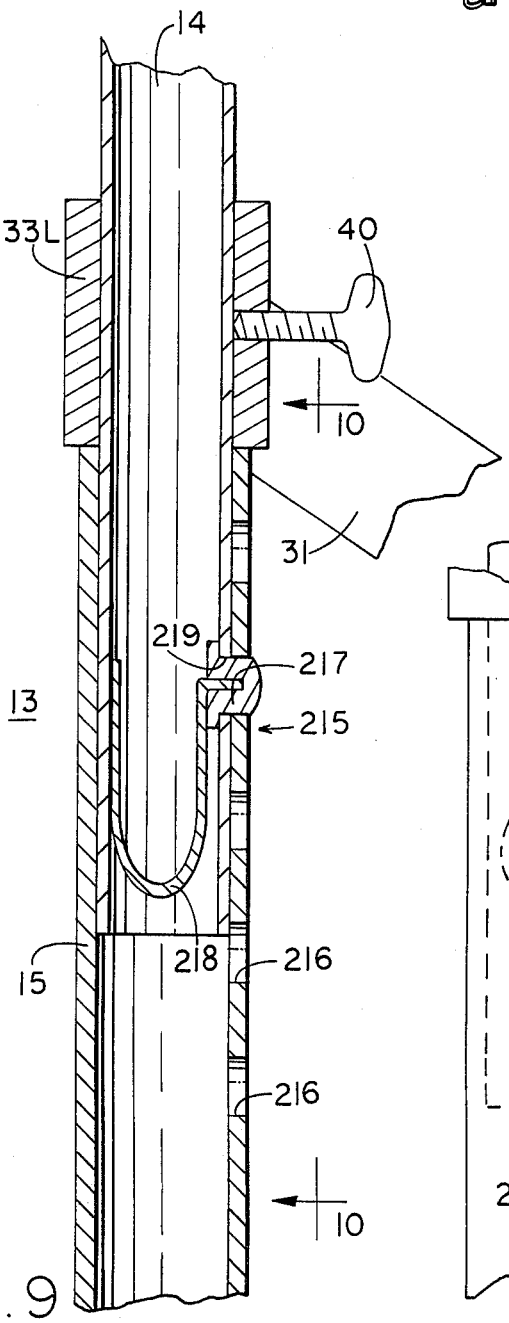
FIG. 9
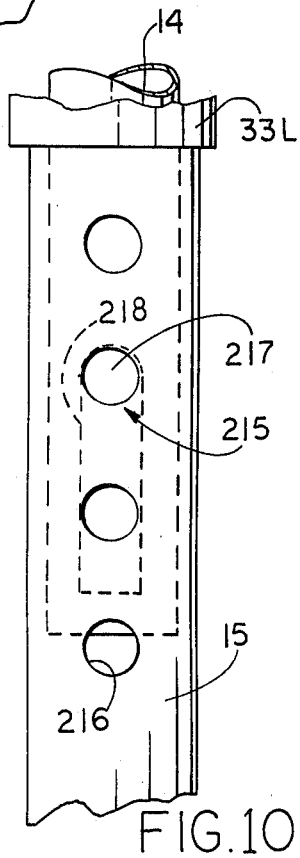
FIG. 10
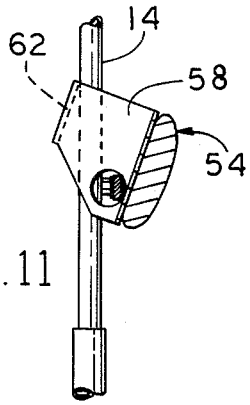
FIG. 11

WALKING AID

This invention relates to invalid or patient walking aids of the kind that are self supporting. More particularly, this invention provides an upright framework upon which the patient can bring to bear his full weight through the use of his arms but which, when released, is supported by wheels so that there is no necessity for the patient to do any lifting to obtain translational movement.

Briefly, this invention provides a walking aid which includes two horizontal hand rails disposed parallel to each other that run alongside the patient. These rails are supported at their ends by four vertical column loading members which contact the floor through rubber feet. The lower extremities of these vertical members are longitudinally stabilized by two horizontal tubular struts. The vertical members are stabilized in the transverse direction in front of the patient by two slanted bars in crisscross arrangement which are pinned at their intersection and so fastened to their vertical members as to permit adjustment of the width of this device. A removable seat mounted on a bar connecting the vertical members behind the patient, provides a buttocks resting place and additional lateral stability to the structure when the device is full open. Four spring-loaded casters carry the weight of the device and are so located outside the load carrying vertical members to provide maximum longitudinal and lateral stability.

Therefore, an object of this invention is to provide invalid and weak patients with a walking aid that they do not have to carry, but by the periodic application of their weight, easily plants this walker in quadrated fashion vertically on the floor so as not to slip or roll. The firmness of this device helps the weak patient to take a weak stride aided with rigid hand control through the walker before translating the walker through the use of its spring-loaded casters to a new location in preparation for another step.

A further object of this invention is to provide a stable, rigid and solidly supported device for use by a crutch patient who lacks articulated motion and must support his body on the walking aid by use of his arms as he swings his torso, legs, and feet from one location to another.

It is another object of this invention to provide patients with the maximum tipping (forward) and toppling (sideways) stability. This is achieved by placing the springloaded casters outside the vertical load carrying members of the structure.

A further object of this invention is to provide a walker that will collapse in the transverse direction to very narrow dimensions to facilitate transportation of the device in a motor vehicle.

An important object of this invention is to provide a rigid walker, easily translatable by means of springloaded casters, with width adjusting means for practical access to facilities incorporating narrow entrance ways, such as phone booths, rest rooms, private homes, etc. More specifically, the width adjustment also permits entry to a public restroom with toilet stall, and retain enough width to straddle the toilet bowl.

The above and other objects and features of the invention will be apparent to those skilled in the art to which this invention pertains from the following detailed description and the drawings, in which:

FIG. 6 is a view in section taken on the line 6—6 in FIG. 3;

FIG. 7 is a view taken in the direction of the arrows 3—3 in FIG. 1, with the device being shown in collapsed configuration;

FIG. 8 is a view in section taken on the line 8—8 in FIG. 6;

FIG. 9 is a view in section taken on an enlarged scale on the line 9—9 in FIG. 1:

FIG. 10 is a fragmentary view in elevation taken in the direction of the arrows 10—10 in FIG. 9; and FIG. 11 is a view in section taken on the same line as FIG. 6, but showing a seat in a retracted position.

In the following detailed description and the drawings, like reference characters indicate like parts.

Figure 1:
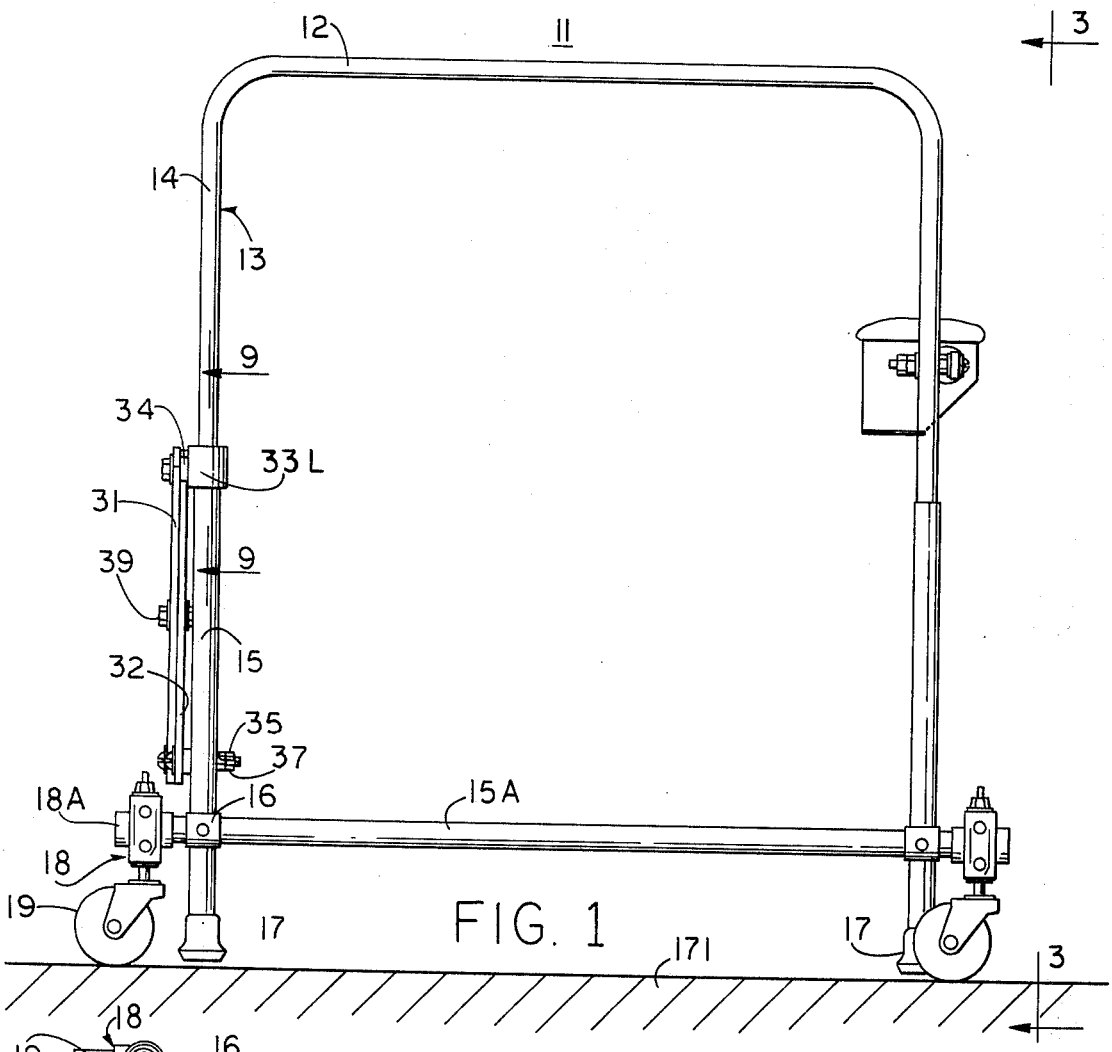
FIG. 1 is a view in side elevation of a walking aid device constructed in accordance with an embodiment of this invention, a bolt and spacer arrangement thereof being partly broken away to reveal details of structure.
Figure 2:
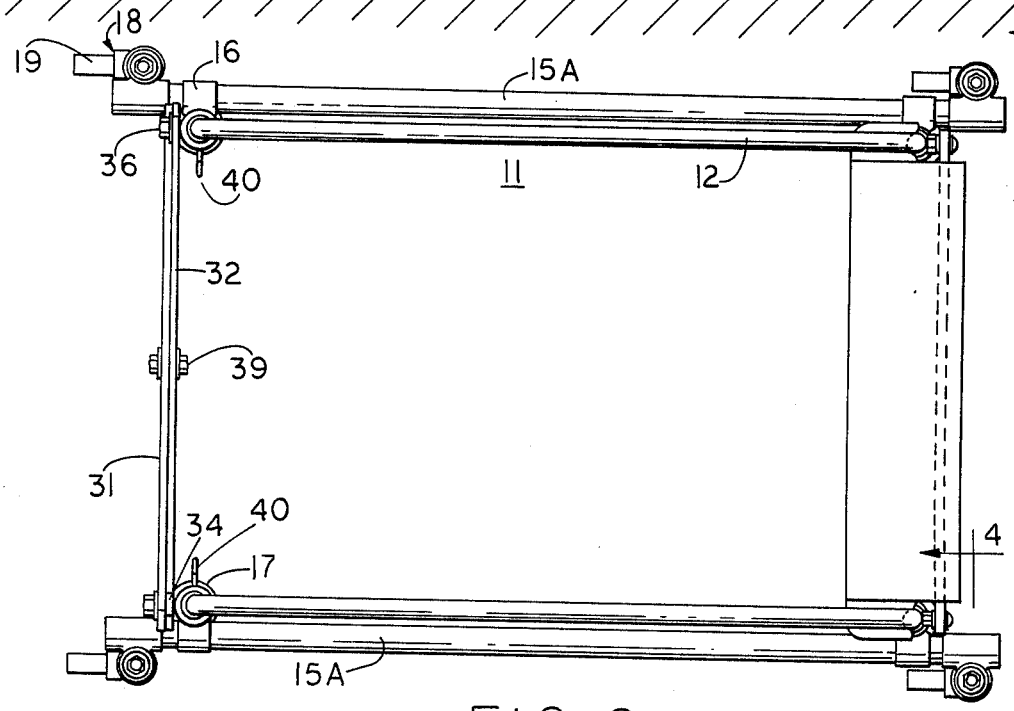
FIG. 2 is a top plan view of the device illustrated in FIG. 1 in erect position.
Figure 4:
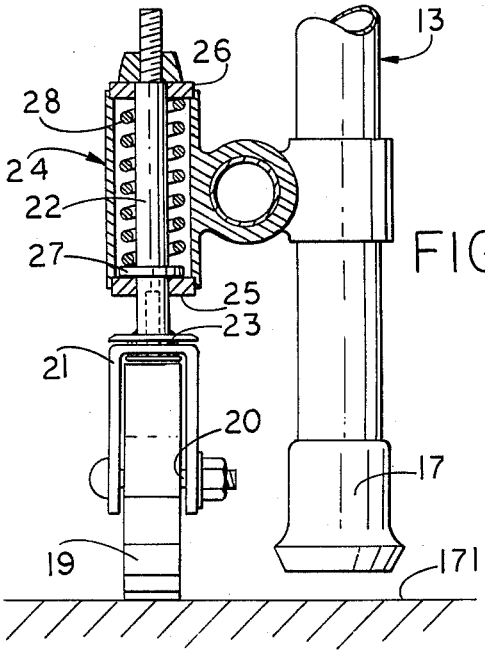
FIG. 4 is a view in section taken on an enlarged scale on the line 4—4 in FIG. 2, with a leg of the device being shown in a normal or up position, i.e., no load being applied to hand rails by a patient.

In FIGS, 1-3 inclusive is shown a walking aid device 11 (hereinafter called walker) constructed in accordance with an embodiment of this invention. The walker 11 includes horizontally disposed hand rails 12 supported at their ends by vertical, column loaded, upright members or legs 13. Each of the members 13 is constructed in two parts, an upper portion 14 telescopes into a lower portion 15 to provide vertical adjustment of the hand rails 12 through pushbutton and hole locking means 215 shown in FIGS. 9 and 10, to be described in greater detail hereinafter. Longitudinal rigidity of the vertical members 13 is maintained by struts 15A (FIGS. 1 and 2), each of which is rigidly fixed to a pair of the members 13 on one side of the device by couplings 16, which locate the struts 15A outside the vertical members 13 as seen in FIG. 2. Lower ends of the members 15 are closed and padded by nonskid feet 17 of rubber or rubber-like material which can contact a supporting surface or floor 171 in a vertical direction to support the weight of a patient (not shown). Caster assemblies 18 are located at end portions 18A of the struts 15 which extend past the vertical support members 13 as shown in FIGS. 1 and 2. Caster wheels 19 support the caster assemblies 18. Each caster wheel 19 is provided with a bearing point on the floor 171 that always remains outside the vertical load members 13. Referring to FIG. 4, the wheel 19 is bearinged on an axle 20 in a fork 21 and pivots with respect to a shaft 22 about bearings 23, all of which is the common caster arrangement. The shaft 22 is retained in a casing 24 by annular end plates 25 and 26, which are rigidly attached to the casing 24 and serve as bushings or bearings as the shaft 22 moves vertically under the restraining limits of a radial collar 27, an integral part of shaft 22, and a compression spring 28, which is limited by the end plate 26. The compression spring 28 is a relatively weak spring, intended to lift the weight of the walker so that the foot 17 normally rides free of the supporting surface or floor 171. Any patient exerting a downward pressure on the structure 13 will compress the spring 28 (FIG. 5) bringing the foot 17 into contact with the floor 171. The walker 11 is then a solid walker, not a movable or wheeled walker with brakes.

Figure 3:
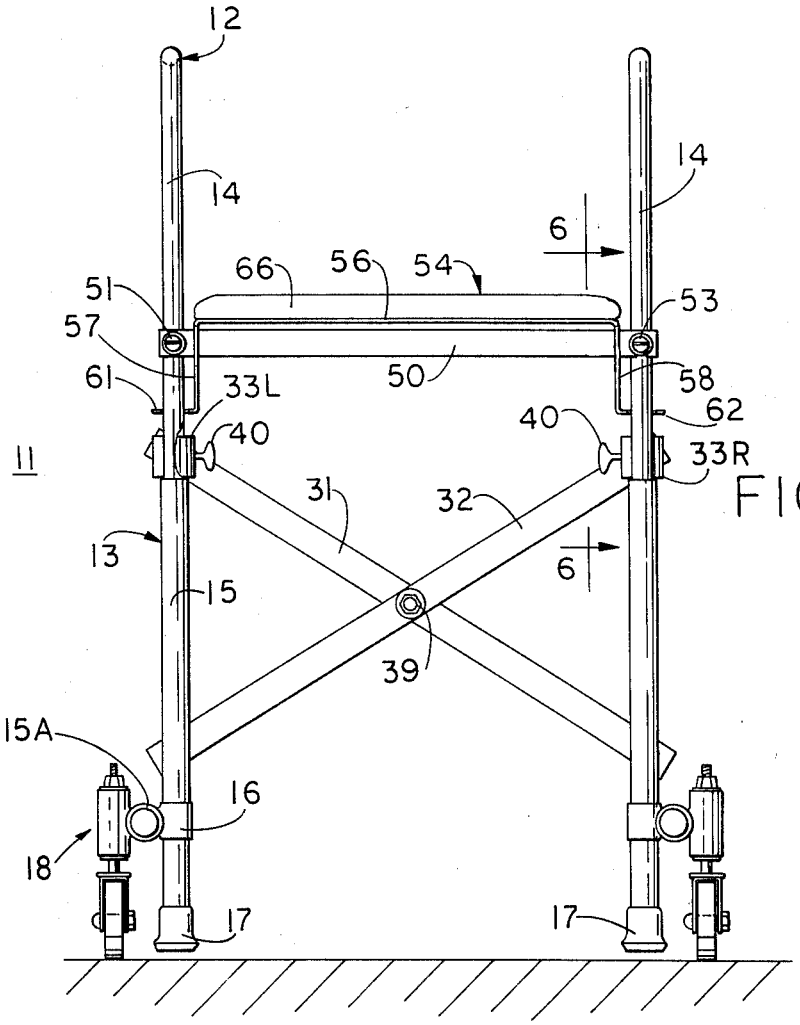
FIG. 3 is an end elevation view of the device illustrated in FIGS. 1 and 2, looking in the direction of the arrows 3—3 in FIG. 1, an upright member being partly broken away to show structural details.

The device can be adjusted to any width permitting access through narrow openings and also to permit straddling of certain devices such as toilets, chairs, etc. (not shown). This function is obtained by bar members 31 and 32 which are arranged in criss-cross fashion as shown in FIGS. 1, 2 and 3. More specifically, the bar member 31 is pivotally secured to a sleeve 33L in spaced relation therewith by a spacer 34. The sleeve 33L is slidably mounted on one of the vertical members 14 which is, in normal use, the front one of the members 14 on the left hand side of the walker. The bar member 31 slants down to the front one of the vertical members 15 on the right side of the device and is spaced and pivotally connected thereto by a nut, bolt and spacer arrangement 35 (FIG. 1). Similarly, a sleeve 33R, slidably mounted on another one of the members 14, which is the right front one of the members 14, is pivotally connected to the bar member 32 by a bolt 36. The bar member 32 crosses the member 31 and is pivotally connected to the front left one of the members 15 through a bolt, nut and spacer arrangement 37 on the left side of the device as shown in FIG. 3. A scissors action is completed by pivotally connecting the bar members 31 and 32 at their intersection with a nut, bolt and washer arrangement 39. The sleeves 33L and 33R can slide up and down the associated vertical members 14 to permit a collapsing action to take place without binding. Thumb screws 40 are provided in the sleeves 33L and 33R so that the patient can lock the bar members 31 and 32 in position for any desired width. As can be seen in FIG. 3, the sleeves 33L and 33R are in the down position for maximum width resting on the tops of the lower portions 15. FIG. 7 shows the sleeves 33L and 33R in their approximate uppermost position to provide a very narrow width for easy transportation in a motor vehicle.

A rear brace 50 is pivotally mounted on the rear one of the members 14 on the patient's left (FIGS. 3 and 7) through a bolt and washer arrangement 51. The free end of member 50 (FIG. 7) incorporates a notch 52 that can nestle down over a bolt 53, mounted into the rear one of the upper portions 14 on the patient's right, and is held in place by gravity. When the rear brace 50 is in place as shown in FIG. 3, it stabilizes the rear portion of the walker 11. In this situation the walker is in its full open configuration. The rear brace 50 can support a seat assembly 54. The seat assembly 54 includes a generally channel shaped frame 56 and downwardly extending main flanges 57 and 58. Openings 59 (one of which is shown in FIG. 6) in the main flanges 57 and 58 receive the rear brace 50. Outwardly extending flanges 61 and 62 (FIG. 3) are mounted on lower ends of the main flanges 57 and 58, respectively, as shown in FIG. 3. As shown in FIG. 8, the outwardly extending flange 62 is provided with a notch 63 which can receive the associated upper portion 14 or the associated lower portion 15 to steady the frame 56. The other outwardly extending flange 61 can be provided with a similar notch, not shown in detail. A seat pad 66 is mounted on the web portion 67 of the frame 56. The openings 59 are adjacent a rear edge of the web portion 67 so that a load on the seat pad 66 tends to swing the seat assembly in a counterclockwise direction, as shown in FIG. 6, around the rear brace 50 to be held with the notches 63 firmly adjacent the upper portions 14 of the rear upright members 13. The seat assembly 54 is shown in FIG. 6 in position for use as a seat. However, the seat assembly 54 can be swung clockwise around the rear brace 50 to the position shown in FIG. 11 at which the outwardly extending flanges engage associated members 14 in the manner the outstanding flange 62 is shown in FIG. 11. In this position, the seat is out of the way and not in position to interfere with use of a toilet bowl or the like (not shown) over which the walker can be advanced.

Figure 5:
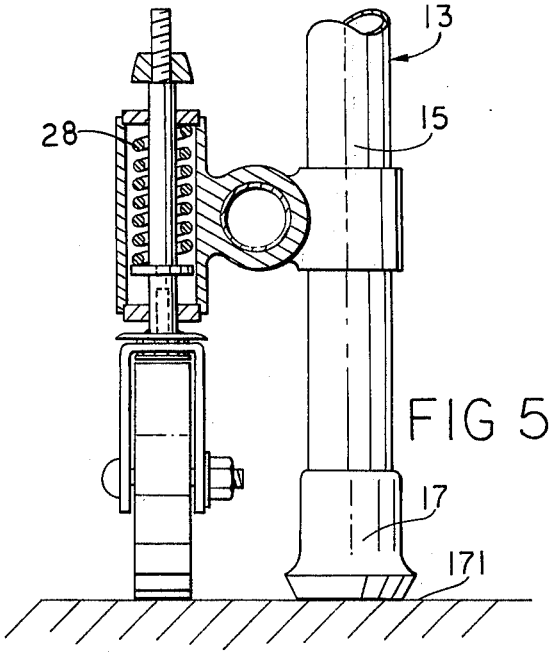
FIG. 5 is a view in section taken on an enlarged scale on the line 4—4 in FIG. 2 with the leg being in a lowered or spring-loaded position, i.e., load being applied to the hand rails by a patient.

As is shown in FIG. 6, the seat assembly 54 can be added to the walker at one's discretion by placing the rear brace 50 through the openings 59. When the walking aid device 11 is released, it can easily be moved from one place to another on the caster wheels 19. However, when a patient puts weight on the hand rails 12 (FIG. 1), the framework of the device readily moves downwardly so that the feet 17 engage the supporting surface 171, as shown in FIG. 5, to immobilize the device. If the patient sits on the seat assembly 54, the device is similarly immobilized. However, as soon as weight is removed from the device, it returns to the normal rollable released position.

As already pointed out, each upright leg member assembly 13 includes pushbutton and hole locking means between the upper portion 14 and the lower portion 15 thereof, one of these pushbutton and hole locking means being shown at 215 in FIGS. 9 and 10. As shown in FIGS. 9 and 10, the lower member modification without departing from the spirit and scope of the appended claims.

Having described my invention, what I claim as new and desire to secure by letters patent is:

1. A walking aid device which comprises horizontal hand rails and vertical support members connected by lateral stabilizing means to form a rigid frame, there being an open space between the hand rails for a patient with hands on the hand rails and feet supported by a supporting surface, the lower extremity of the vertical support members incorporating rubber feet that can contact the supporting surface in a rigid and non-sliding fashion, said walking aid device incorporating casters which travel on the supporting surface in quadraped manner that are pivotally mounted to the frame, longitudinal stabilizing tubes horizontally disposed near the lower ends of said vertical support members, said longitudinal stabilizing tubes extending outwardly past the confines of the vertical members to form caster mounting means in such a manner as to place caster wheel bearing points outside the columnar load path of the vertical support members and spring means between the casters and said frame, so that the frame is carried on the casters when vertical load is absent, said spring means being relatively weak insofar as the springs will carry slightly more than the frame's structural weight so that the patient can load the frame to bring the rubber feet into periodic contact with the floor providing a firm means of support when the frame is loaded by the patient, the rubber feet engaging the supporting surface to prevent advance of the device when the frame is loaded.

2. A walking aid device as in claim 1 wherein the lateral stabilizing means includes a mechanical scissors device including a pair of transverse bars rotatably fixed at their intersection, each of the transverse bars being pivotally connected at one end to one of the vertical support members, each of the transverse bars being pivotally connected at its opposite end to a sleeve that travels up and down one of the vertical support members to which the other transverse bar is pivotally connected for adjustment of the lateral dimension of the frame, said sleeves containing thumb screws for locking scissors and width in a desired position.

3. A walking aid device as in claim 2 wherein said sleeves can travel up to an almost vertical position for the scissors, providing the device to be laterally collapsible for transportation in a motor vehicle.

4. A walker which comprises a pair of side frames, means interconnecting the side frames to form an enclosure, each of the side frames including a pair of upright legs, a hand grip bar connecting upper end portions of the legs, there being an open space between the hand grip bars for a patient with hands on the hand grip bars and feet supported on a supporting surface, an elongated caster support frame linking the upright legs spaced below the hand grip bar and caster supports attached to opposite end portions of the caster support frame, the caster support frames being outboard of the vertical members and extending forwardly and rearwardly beyond the vertical members, the caster supports being mounted on the caster support frames forwardly and rearwardly of the vertical members, a caster mounted on each caster support, and a spring mounted in each caster support supported by the associated caster and urging the associated end portion of the caster support frame to a raised position in which the lower ends of the associated legs are spaced above the supporting surface on which the casters run, the springs yielding when weight is applied to the bars to permit the lower ends of the legs to engage the supporting surface, the legs engaging the supporting surface to prevent advance of the device when the support frame is in a lowered position.

5. A walker as in claim 4 wherein the means interconnecting the side frames includes a cross brace pivotally connected to one of the side frames and releasably attached to the other of the side frames, and a seat assembly mounted on the cross brace, the seat assembly including a generally channel shaped frame, there being openings in main flanges of the channel shaped frame receiving the cross braces, and outwardly extending flanges on the main flanges, the outwardly extending flanges engaging upright rear legs of the side frames to limit swinging of the seat assembly on the cross brace.

* * * * *